US012312828B2

(12) United States Patent
Wang

(10) Patent No.: US 12,312,828 B2
(45) Date of Patent: May 27, 2025

(54) HINGED QUICK INSTALLATION FENCE

(71) Applicant: Guangzhou Mibo Zhilian Technology Co. LTD, Guangzhou (CN)

(72) Inventor: Haobo Wang, Urumqi (CN)

(73) Assignee: GUANGZHOU MIBO ZHILIAN TECHNOLOGY CO. LTD, Guangzhou (CN)

( * ) Notice: Subject to any disclaimer, the term of this patent is extended or adjusted under 35 U.S.C. 154(b) by 447 days.

(21) Appl. No.: 17/853,986

(22) Filed: Jun. 30, 2022

(65) Prior Publication Data

US 2023/0392409 A1 Dec. 7, 2023

(30) Foreign Application Priority Data

Jun. 7, 2022 (CN) ..... 202221421329.1

(51) Int. Cl.
*E04H 17/16* (2006.01)
*E04H 17/00* (2006.01)

(52) U.S. Cl.
CPC ..... *E04H 17/17* (2021.01); *E04H 17/013* (2021.01)

(58) Field of Classification Search
CPC ..... E01F 13/022; E06B 11/02; E06B 11/021; E04H 17/013; E04H 17/16; E04H 17/161; E04H 17/163; E04H 17/17; E04H 17/18; E04H 17/185
See application file for complete search history.

(56) References Cited

U.S. PATENT DOCUMENTS 749,015 A * 1/1904 Bailey ..... E04H 17/18 256/26
1,182,018 A * 5/1916 Koenig ..... A01K 3/00 256/25
1,521,240 A * 12/1924 Graham ..... E04H 17/18 256/25
2,074,688 A * 3/1937 Don ..... E04H 17/163 256/73
2,581,318 A * 1/1952 Bartlett ..... E04H 17/18 256/25
2,622,848 A * 12/1952 Campbell ..... E04H 17/18 D25/38.1
2,651,502 A * 9/1953 Carvelo ..... E04H 17/18 256/33
2,766,016 A * 10/1956 Miller ..... E04H 17/18 D25/48.5

(Continued)

*Primary Examiner* — Jonathan P Masinick

(57) ABSTRACT

The present invention relates to a hinged quick installation fence, comprising at least two fence piece units and a ground inserting rod, the fence piece unit includes at least two fence pieces and a connecting hinge, the fence pieces are rotatably connected together by the connecting hinge, and the leftmost fence piece is provided with a left hinge member, the rightmost fence piece is provided with a right hinge member, the adjacent fence piece units are connected in pairs correspondingly through the left hinge member and the right hinge member, and the ground inserting rod is inserted into the left hinge member and the right hinge member and fixed, and the fence piece units form a fence for use. The advantageous effects of the present invention are as following: the hinged quick installation fence can be transported, installed and stored more conveniently by combining two or more fence pieces into a fence piece unit, thereby saving manpower and time costs.

5 Claims, 10 Drawing Sheets

(56) References Cited

U.S. PATENT DOCUMENTS 3,204,606 A * 9/1965 Parr ..... E04H 17/18 16/236
3,423,072 A * 1/1969 Morey ..... E04H 17/18 D25/43
3,469,822 A * 9/1969 O'Brien ..... E04H 17/18 256/25
4,356,999 A * 11/1982 McShane ..... A01K 3/001 256/73
5,058,863 A * 10/1991 Maffet ..... F16B 5/0685 256/26
5,664,769 A * 9/1997 Sadinsky ..... E04H 4/06 256/25
D410,289 S * 5/1999 Howard ..... D25/38.1
D552,751 S * 10/2007 Van Buskirk ..... D30/114
7,293,530 B2 * 11/2007 Italiano ..... A01K 1/034 256/25
8,152,141 B2 * 4/2012 Langenwalter ..... E04H 17/013 256/25
8,596,619 B2 * 12/2013 Volin ..... E06B 11/021 256/73
10,577,826 B2 * 3/2020 Lohnes ..... A47F 5/103
11,208,829 B2 * 12/2021 Reneau ..... E04H 17/161
11,421,441 B2 * 8/2022 Howell ..... E04H 17/20
11,725,414 B2 * 8/2023 Langenwalter ..... E04H 17/161 256/26
2003/0146426 A1 * 8/2003 Ray ..... A01K 1/0035 256/59
2004/0188667 A1 * 9/2004 Ray ..... E04H 17/18 256/67
2005/0218393 A1 * 10/2005 Larsen ..... E04H 17/161 256/32
2007/0246696 A1 * 10/2007 Campbell ..... E04H 17/18 256/21
2011/0290194 A1 * 12/2011 Gardner ..... E04H 17/18 256/25
2012/0112148 A1 * 5/2012 Hammond ..... E04H 17/1439 256/25

* cited by examiner

HINGED QUICK INSTALLATION FENCE

CROSS REFERENCE TO RELATED APPLICATION

This application claims priority benefit of Chinese Invention Application No. 202221421329.1, filed on Jun. 7, 2022, and the entire contents of which are incorporated herein by reference.

TECHNICAL FIELD OF THE INVENTION

The invention relates to a technical field of fences, in particular to a hinged quick installation fence.

BACKGROUND OF THE INVENTION

Fences are mainly used for safety protection and decoration and beautification in residences, highways, commercial areas, public places and other occasions. The fence also faces the risk of being damaged by man-made or natural environment while carrying out safety protection. The fence is generally composed of multiple fence pieces. It is difficult to fix the fence pieces to each other during installation and cannot guarantee a fixed connection with the ground. Therefore, under normal circumstances, two fence pieces are connected to each other by a connecting part with a connecting slot. Then insert a ground inserting rod for inserting into the ground into the connecting slot and then insert it into the ground to realize the fixed connection between the fence and the ground.

The existing metal fence, which is generally a single piece, cannot be placed and erected separately. The first two metal fence pieces need to be supported separately and inserted by a ground inserting rod to stand, and the fence pieces need to be put away several times during storage. Due to the large number, it is also easier to slide during the handling process. In addition, the hinges of the existing fence are made of iron wires, which are not easy to fix, and the fixing rod is not bound and supported, which will shake and cause the connection angle with the ground to be offset, resulting in an unstable connection between the fence and the ground.

SUMMARY OF THE INVENTION

The purpose of the present invention is to provide a hinged quick installation fence, wherein by combining two or more fence pieces into a fence piece unit, it can be carried, installed and stored more conveniently, thereby saving manpower and time costs.

In order to achieve the above-mentioned purpose of the present invention, the present invention provides the following technical solutions:

A hinged quick installation fence, comprising at least two fence piece units and a ground inserting rod, the fence piece unit includes at least two fence pieces and a connecting hinge, the fence pieces are rotatably connected together by the connecting hinge, and the leftmost fence piece is provided with a left hinge member, the rightmost fence piece is provided with a right hinge member, the adjacent fence piece units are connected in pairs correspondingly through the left hinge member and the right hinge member, and the ground inserting rod is inserted into the left hinge member and the right hinge member and fixed, and the fence piece units form a fence for use.

Preferably, at least one fence gate is also included, the fence gate is arranged on the fence piece, and the fence gate can provide a way for users to enter and exit the fence.

Preferably, the fence gate includes a gate frame, a bolt and a lifting connecting shaft, a slot is arranged on the fence piece, the fence gate is fixed by inserting the bolt into the slot, the lifting connecting shaft connects the gate frame and the fence piece, and the lifting connecting shaft is provided with a position limiter and an avoidance part. When the fence gate needs to be opened, the position limiter is inserted into the avoidance part, the lifting connecting shaft is unlocked, the gate frame is lifted up along the lifting connecting shaft to drive the bolt to unlock from the slot, and the bolt leaves the slot and is no longer locked, and then the gate frame is rotated to open the fence gate. When the fence gate needs to be closed, the gate frame is rotated to make the bolt reach near the slot, the bolt is inserted into the slot to lock, and then the position limiter is removed out from the avoidance part, and the lifting connecting shaft is locked. Because the position limiter restricts the lifting upward movement of the gate frame along the lifting connecting shaft, the gate frame cannot be lifted, the bolt cannot be removed out from the slot, and the fence gate is closed and cannot be easily opened.

Preferably, the left hinge member and the right hinge member are provided with hinge holes that penetrate vertically, the hinge hole on the left hinge member and the hinge hole on the right hinge member are coaxially aligned, and the ground inserting rod is inserted into the hinge holes and fixed, and the left hinge member and the right hinge member can be tightly connected with the ground inserting rod, so that the connection of the fence piece units is tighter.

Preferably, a ground inserting end of the ground inserting rod is provided with a shrinking tube tip, and the shrinking tube tip is convenient for the ground inserting rod to be inserted and fixed into the ground with a small force, thereby saving manpower.

Preferably, the hand-held end of the ground inserting rod is provided with a holding member, which is convenient for the user to pull out the ground inserting rod from the ground through the holding member.

Preferably, the fence piece unit is provided with an internal hinge member, when the fence is in use, the ground inserting rod is inserted and fixed into the internal hinge member, which can improve the anti-risk capability of the fence and further ensure the use of the fence.

Preferably, the fence piece includes a frame body and a wire mesh such as iron wire mesh, and the wire mesh is arranged inside the frame body. Since the frame body has higher pressure capacity and weather resistance than the wire mesh, the frame body is not easy to be damaged. Therefore, the fence piece added with the frame body has higher safety and service life than the fence piece in the prior art composed of a whole wire mesh, and is easy to use.

Compared with the prior art, the advantageous effects of the present invention are as following:

the present invention is provided with a fence piece unit, which includes at least two fence pieces and a connecting hinge, and a fence piece and a fence piece are rotatably connected together through the connecting hinge to form a fence piece unit for use. When the fence in use, the fence piece unit can be directly removed out and connected with other fence piece units in pairs to form a fence; when retracting the fence, after separating the fence piece units from each other, the fence pieces in the fence piece unit are rotated and closed along the connecting hinge, and then the fence piece units are transported and stowed. Compared with the prior art, in the present invention two or more fence pieces are combined into one fence piece unit, which can be directly transported without transporting the fence pieces one by one, and the fence pieces can be rotated and closed along the connecting hinge, such that it is more convenient to carry and use, and saves time and manpower, and it only needs to connect the fence piece units to form and retract the fence, and does not need to connect the fence pieces one by one, such that the connection saves time and effort, and it is easy to use;

moreover, in the present invention, a left hinge member is arranged on the leftmost fence piece of the fence piece unit, a right hinge member is arranged on the rightmost fence piece of the fence piece unit, and the left hinge member of a fence piece unit is connected with the right hinge member of another fence piece unit. Thereafter the ground inserting rod passes through the left hinge member and the right hinge member until it is inserted into the ground and fixed. Since the left hinge member and the right hinge member are arranged on the fence piece, the fence can be inserted into the ground and fixed, and the adjacent fence piece units can be closely connected with the ground inserting rod, and the left hinge member and the right hinge member play the role of supporting and restraining the ground inserting rod, so the anti-interference ability of the ground inserting rod is enhanced, and the ground inserting rod is not easy to be blown down by the wind;

furthermore, the fence piece unit includes at least two fence pieces, and the fence pieces are rotatably connected together by a connecting hinge. The fence pieces can rotate around the connecting hinge. When the fence pieces are rotated to make a certain angle between the two fence pieces, the fence piece units can temporarily stand on the flat ground without human assistance, i.e. supporting by hand, and the user can connect the adjacent fence piece units alone without the assistance of other people, thereby saving manpower and installing convenient.

Therefore, the present invention provides a hinged quick installation fence, which can be transported, installed and stored more conveniently by combining two or more fence pieces into a fence piece unit, thereby saving manpower and time costs.

DETAILED DESCRIPTION OF THE PREFERRED EMBODIMENT

The technical solutions in the embodiments of the present invention will be explicitly and completely described below in conjunction with the accompanying drawings in the embodiments of the present invention. Apparently, the described embodiments are only some of the embodiments of the present invention, rather than all of the embodiments. Based on the embodiments of the present invention, all the other embodiments obtained by those of ordinary skill in the art without inventive efforts shall fall within the protection scope of the present invention.

It is to be noted that, all the directional indications (such as up, down, left, right, front, rear . . . ) in the embodiments of the present invention are only used to explain the relative positional relationships and motion conditions between various components in a particular attitude (as shown in the accompanying drawings). If the particular attitude changes, the directional indication also changes accordingly.

In addition, descriptions such as "first" and "second" in the present invention are only intended for illustrative purposes, but cannot be construed as indicating or implying their relative importance or implicitly indicating the number of the technical features as indicated. Thus, the features defined with "first" and "second" may explicitly or implicitly include at least one of the features; next, in the description of the present invention, "a plurality of" means at least two, such as two or three, unless otherwise expressly and specifically limited.

In the present invention, unless otherwise expressly specified and defined, the terms such as "connected" and "fixed" should be understood in a broad sense, for example, "fixed" may be a fixed connection, a detachable connection, or an integral formation; may be a mechanical connection or an electrical connection; may be a direct connection or an indirect connection through an intermediate medium, and may be an internal communication between two elements or an interaction relationship between two elements, unless otherwise specifically defined. For those of ordinary skill in the art, the specific meanings of the above-described terms in the present invention may be understood according to specific conditions.

In addition, the technical solutions among various embodiments of the present invention may be combined with each other, but has to be based on a possible implementation by those of ordinary skill in the art. When the combination of technical solutions involves mutual contradiction or cannot be implemented, it should be considered that such combination of technical solutions neither is present nor falls within the protection scope claimed by the present invention.

Figure 1:
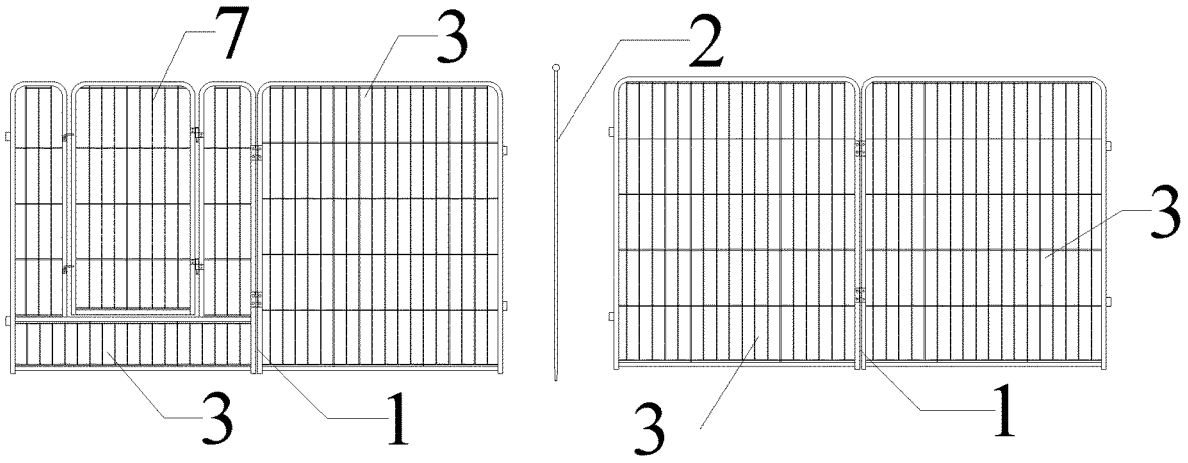
FIG. 1 is an overall schematic structural view of the present invention.
Figure 2:
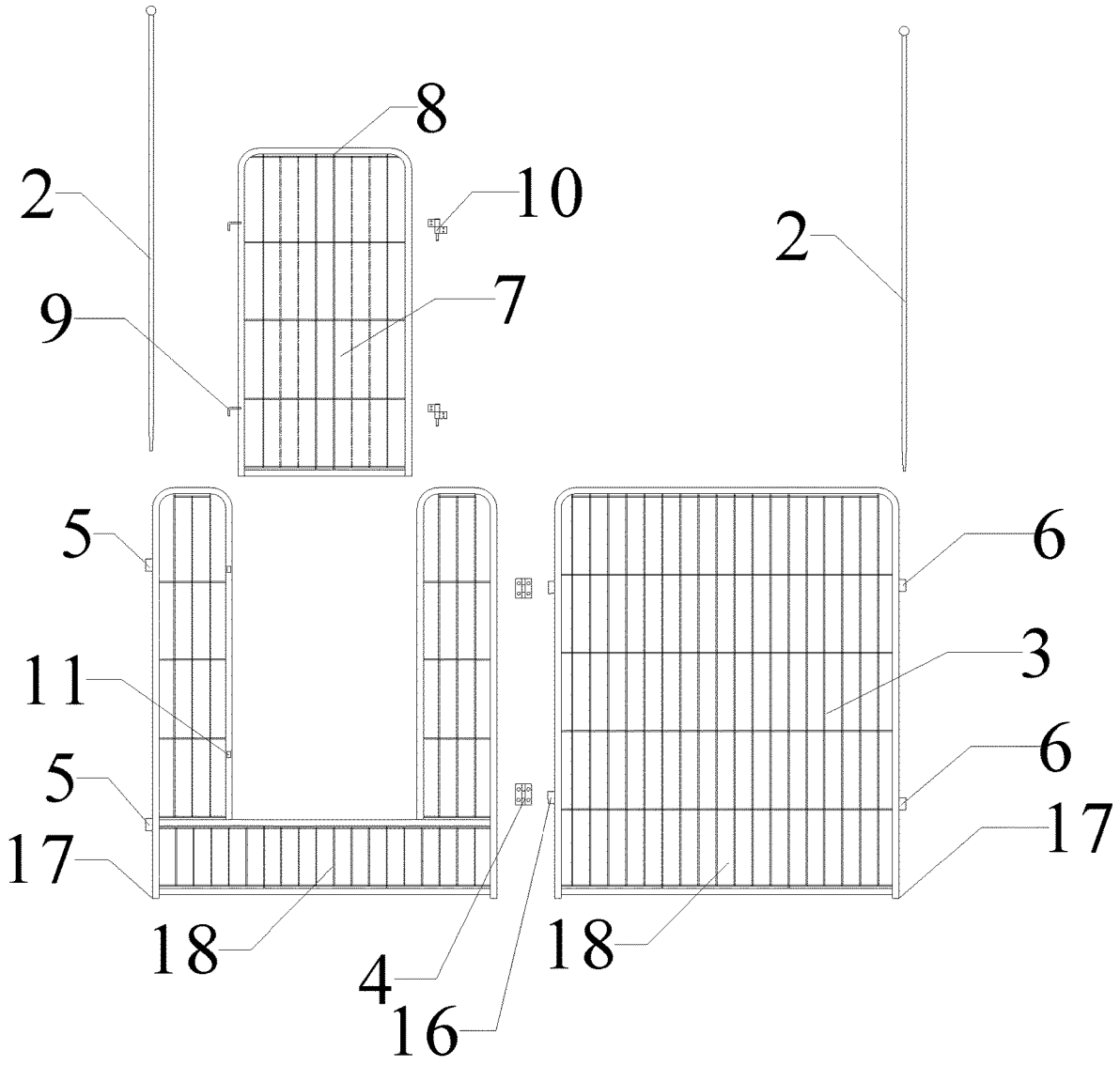
FIG. 2 is an exploded schematic structural view of a fence piece unit comprising a fence gate in the present invention.
Figure 3:
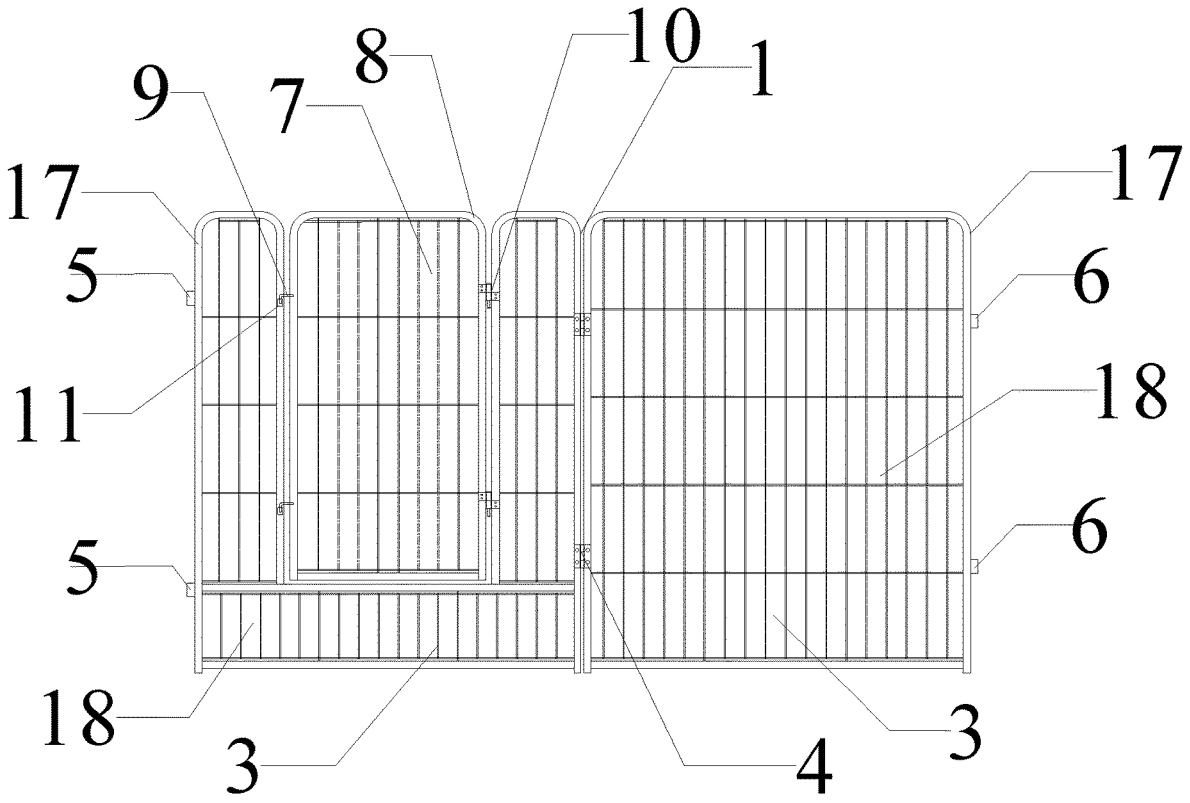
FIG. 3 is an assembly schematic structural view of a fence piece unit comprising a fence gate in the present invention.
Figure 4:
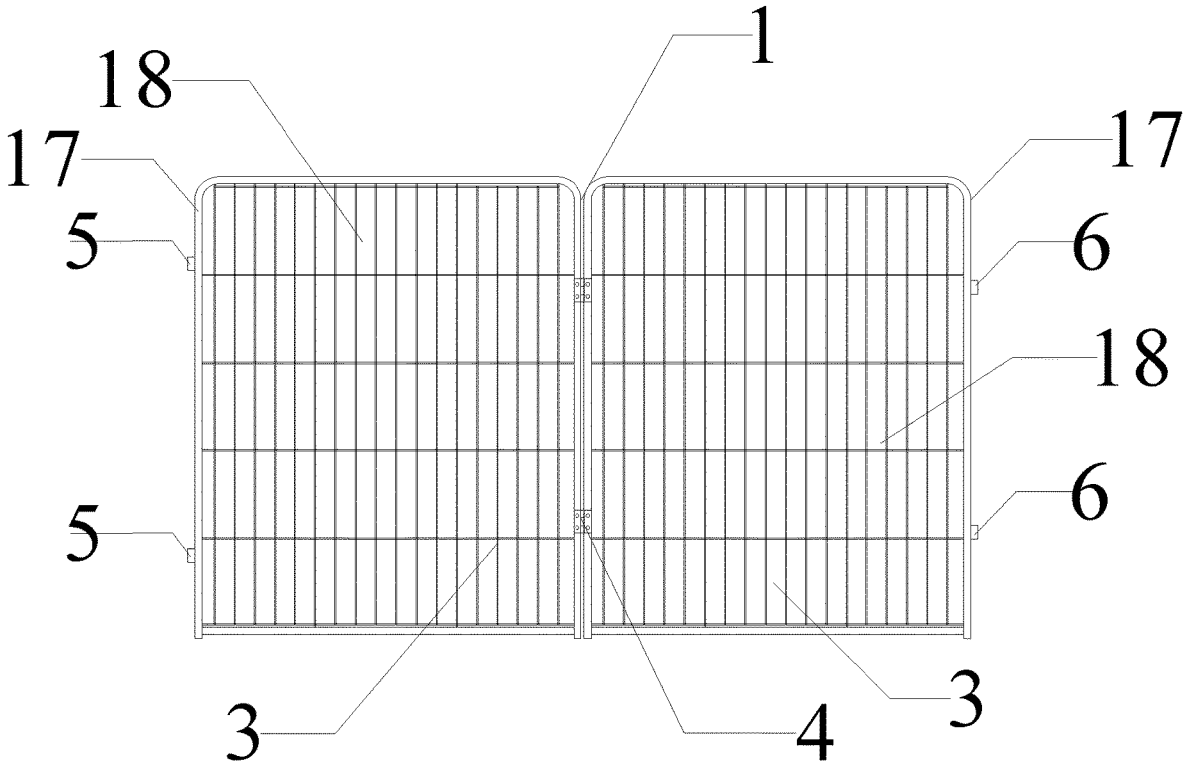
FIG. 4 is an assembly schematic structural view of a fence piece unit in the present invention.
Figure 5:
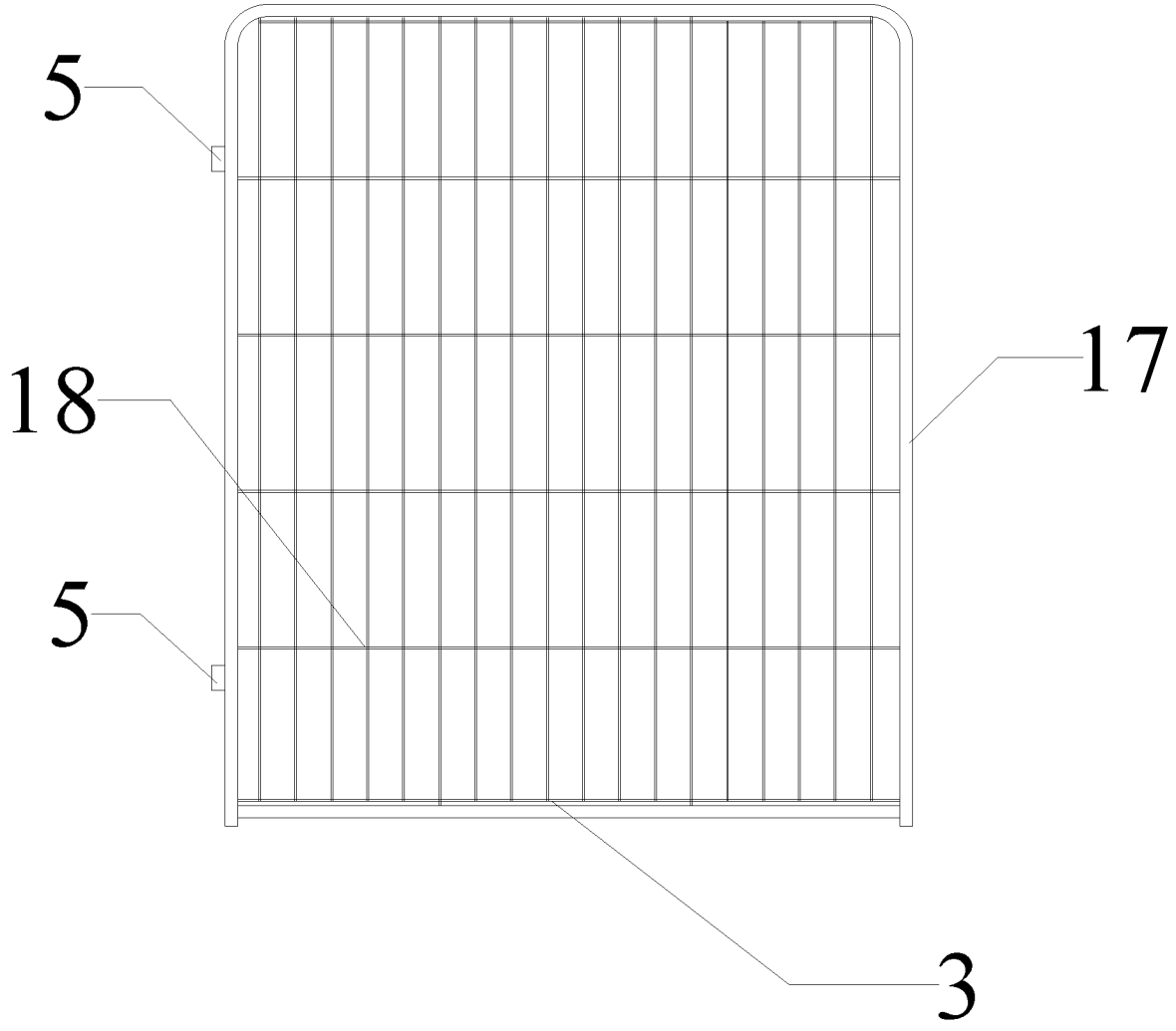
FIG. 5 is an overall schematic structural view of a fence piece with a left hinge member in the present invention.
Figure 6:
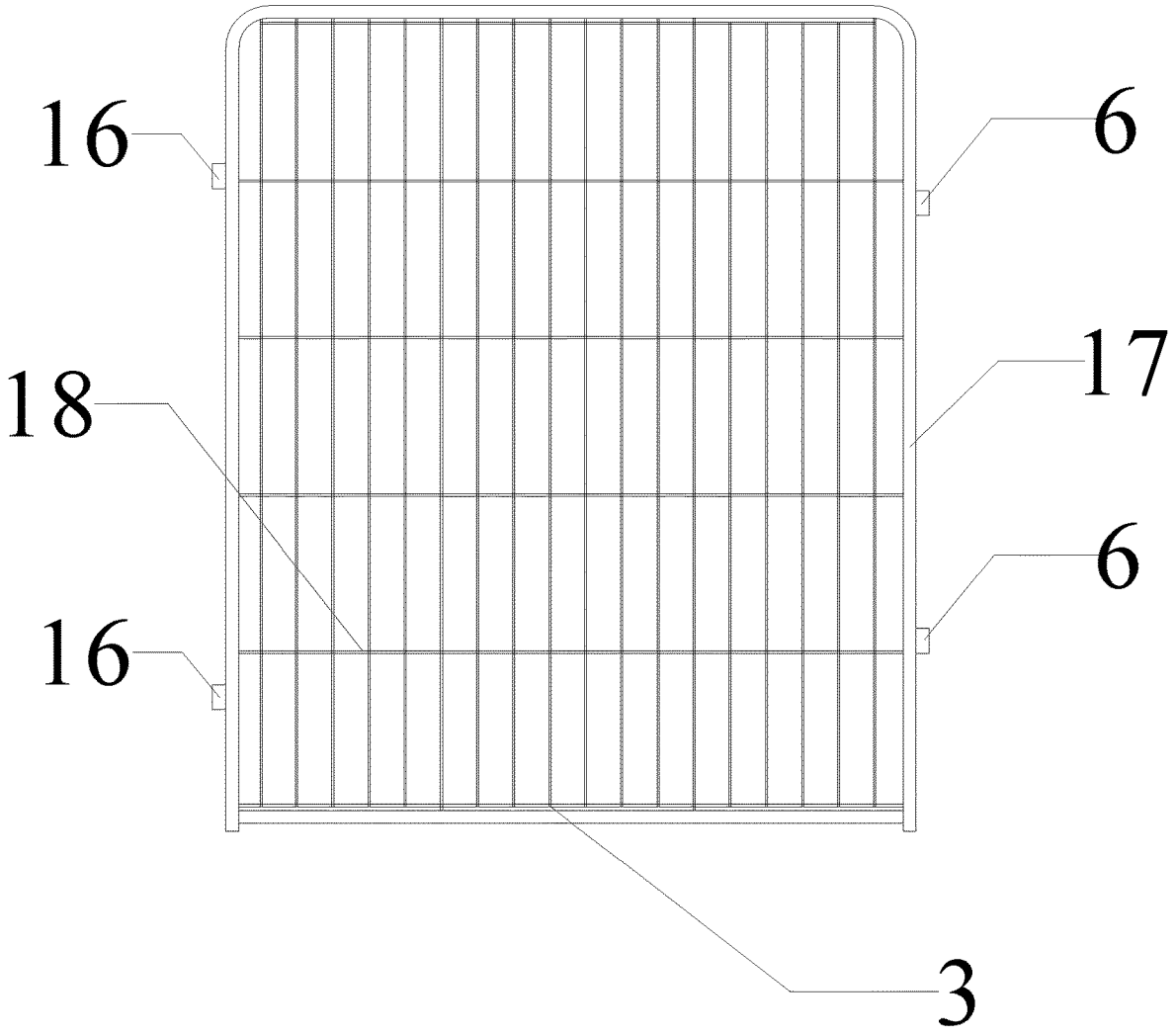
FIG. 6 is an overall schematic structural view of a fence piece with a right hinge member in the present invention.
Figure 7:
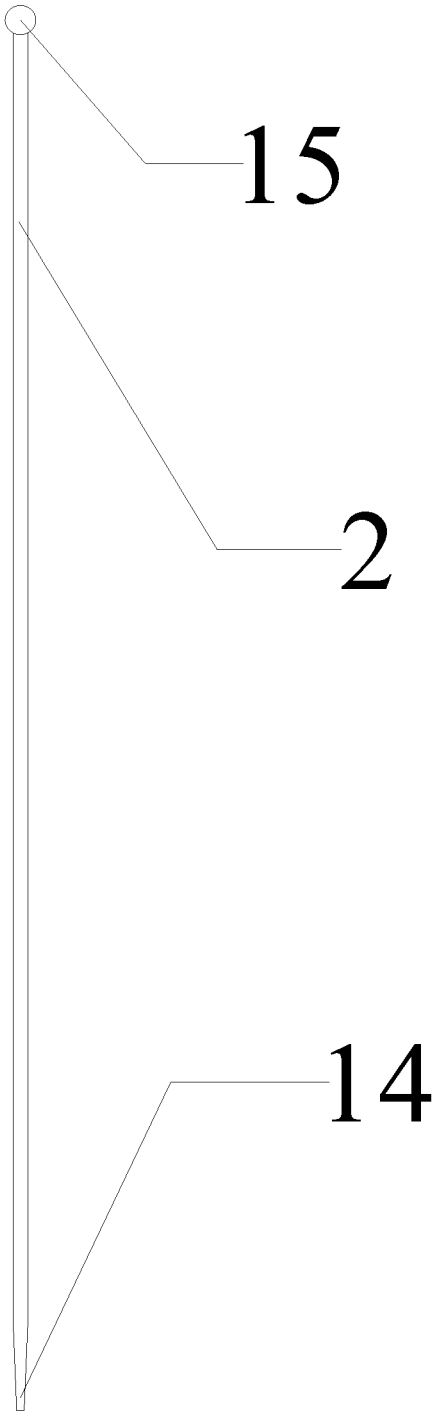
FIG. 7 is a schematic structural view of a ground inserting rod in the present invention.
Figure 8:
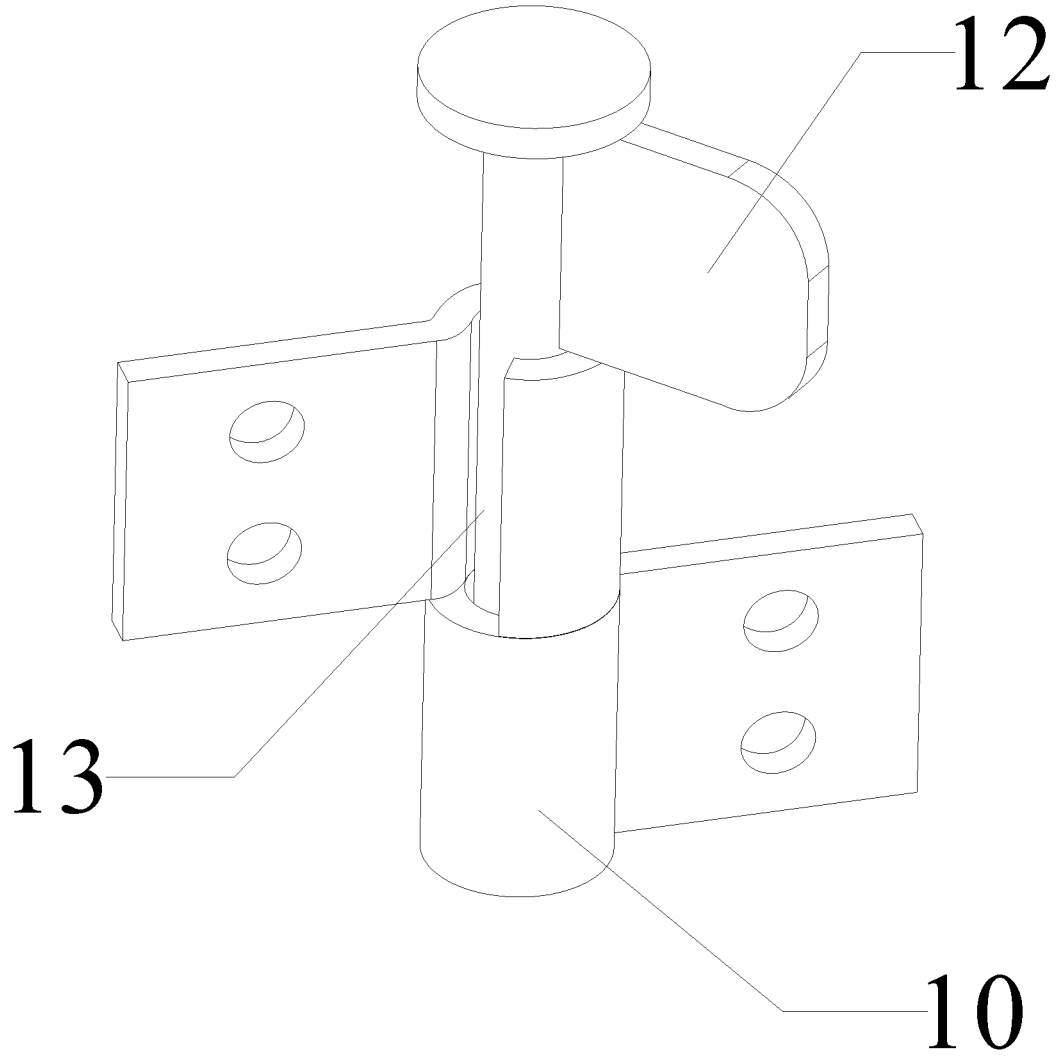
FIG. 8 is a schematic structural view of a locked lifting connecting shaft in the present invention.
Figure 9:
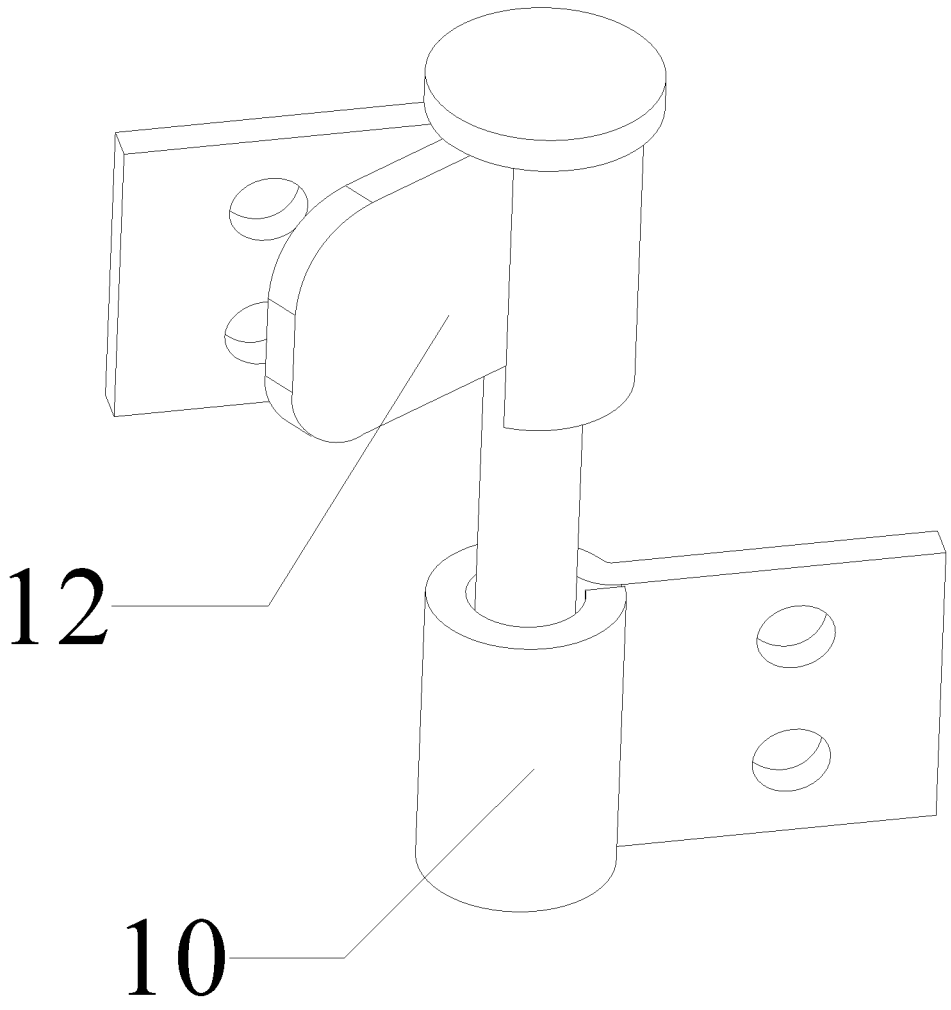
FIG. 9 is a schematic structural view of an unlocked lifting connecting shaft in the present invention.
Figure 10:
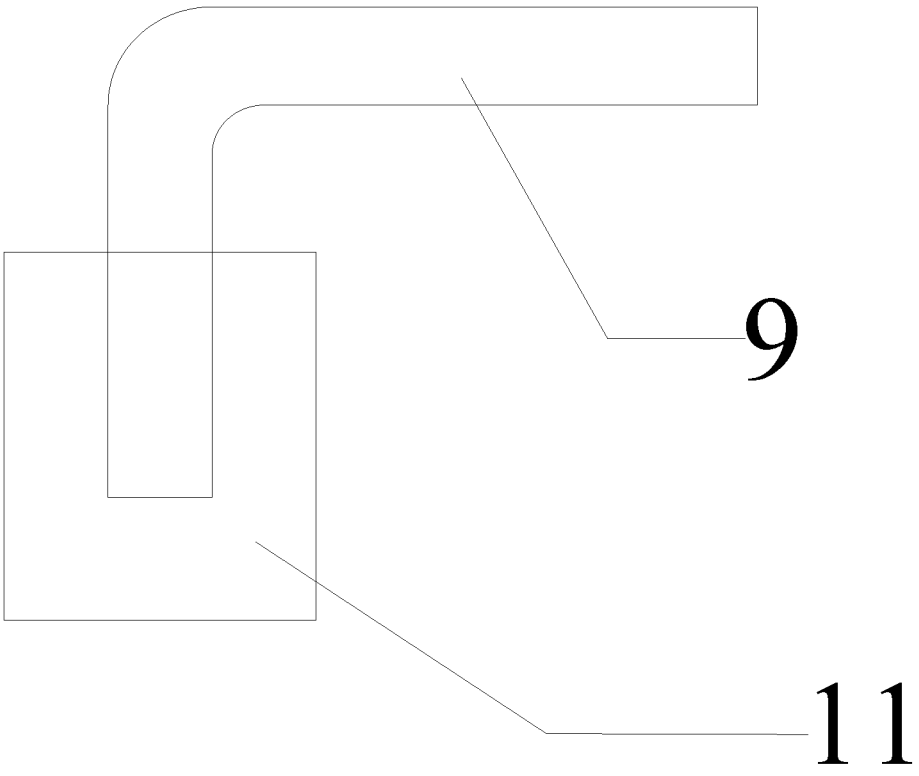
FIG. 10 is a schematic structural view of a bolt fixed in a slot in the present invention.

Please refer to FIG. 1-FIG. 10, FIG. 1 is an overall schematic structural view of the present invention; FIG. 2 is an exploded schematic structural view of a fence piece unit comprising a fence gate in the present invention; FIG. 3 is an assembly schematic structural view of a fence piece unit comprising a fence gate in the present invention; FIG. 4 is an assembly schematic structural view of a fence piece unit in the present invention; FIG. 5 is an overall schematic structural view of a fence piece with a left hinge member in the present invention; FIG. 6 is an overall schematic structural view of a fence piece with a right hinge member in the present invention; FIG. 7 is a schematic structural view of a ground inserting rod in the present invention; FIG. 8 is a schematic structural view of a locked lifting connecting shaft in the present invention; FIG. 9 is a schematic structural view of an unlocked lifting connecting shaft in the present invention; FIG. 10 is a schematic structural view of a bolt fixed in a slot in the present invention.

An embodiment of the present invention provides a wall-mounted screen bracket. The names of the members corresponding to the reference signs in the FIGures are as follows: a fence piece unit 1, a ground inserting rod 2, a fence piece 3, a connecting hinge 4, a left hinge member 5, a right hinge member 6, fence gate 7, a gate frame 8, a bolt 9, a lifting connecting shaft 10, a slot 11, a position limiter 12, an avoidance part 13, shrinking tube tip 14, holding member 15, an internal hinge member 16, frame body 17, wire mesh 18.

A hinged quick installation fence, comprising at least two fence piece units 1 and a ground inserting rod 2, the fence piece unit 1 includes at least two fence pieces 3 and a connecting hinge 4, the fence pieces 3 are rotatably connected together by the connecting hinge 4, and the leftmost fence piece 3 is provided with a left hinge member 5, the rightmost fence piece 3 is provided with a right hinge member 6, the adjacent fence piece units 1 are connected in pairs correspondingly through the left hinge member 5 and the right hinge member 6, and the ground inserting rod 2 is inserted into the left hinge member 5 and the right hinge member 6 and fixed, and the fence piece units 1 form a fence for use.

At least one fence gate 7 is also included, the fence gate 7 is arranged on the fence piece 3, and the fence gate 7 can provide a way for users to enter and exit the fence.

The fence gate 7 includes a gate frame 8, a bolt 9 and a lifting connecting shaft 10, a slot 11 is arranged on the fence piece 3, the fence gate 7 is fixed by inserting the bolt 9 into the slot 11, the lifting connecting shaft 10 connects the gate frame 8 and the fence piece 3, and the lifting connecting shaft 10 is provided with a position limiter 12 and an avoidance part 13. When the fence gate 7 needs to be opened, the position limiter 12 is inserted into the avoidance part 13, the lifting connecting shaft 10 is unlocked, the gate frame 8 is lifted up along the lifting connecting shaft 10 to drive the bolt 9 to unlock from the slot 11, and the bolt 9 leaves the slot 11 and is no longer locked, and then the gate frame 8 is rotated to open the fence gate 7. When the fence gate 7 needs to be closed, the gate frame 8 is rotated to make the bolt 9 reach near the slot 11, the bolt 9 is inserted into the slot 11 to lock, and then the position limiter 12 is removed out from the avoidance part 13, and the lifting connecting shaft 10 is locked. Because the position limiter 12 restricts the lifting upward movement of the gate frame 8 along the lifting connecting shaft 10, the gate frame 8 cannot be lifted, the bolt 9 cannot be removed out from the slot 11, and the fence gate 7 is closed and cannot be easily opened.

The left hinge member 5 and the right hinge member 6 are provided with hinge holes that penetrate vertically, the hinge hole on the left hinge member 5 and the hinge hole on the right hinge member 6 are coaxially aligned, and the ground inserting rod 2 is inserted into the hinge holes and fixed, and the left hinge member 5 and the right hinge member 6 can be tightly connected with the ground inserting rod 2, so that the connection of the fence piece units 1 is tighter.

The ground inserting end of the ground inserting rod 2 is provided with a shrinking tube tip 14, and the shrinking tube tip 14 is convenient for the ground inserting rod 2 to be inserted and fixed into the ground with a small force, thereby saving manpower.

The hand-held end of the ground inserting rod 2 is provided with a holding member 15, which is convenient for the user to pull out the ground inserting rod 2 from the ground through the holding member 15.

The fence piece unit 1 is provided with an internal hinge member 16, when the fence is in use, the ground inserting rod 2 is inserted and fixed into the internal hinge member 16, which can improve the anti-risk capability of the fence and further ensure the use of the fence.

The fence piece 3 includes a frame body 17 and a wire mesh 18 such as iron wire mesh, and the wire mesh 18 is arranged inside the frame body 17. Since the frame body 17 has higher pressure capacity and weather resistance than the wire mesh 18, the frame body is not easy to be damaged. Therefore, the fence piece 3 added with the frame body 17 has higher safety and service life than the fence piece in the prior art composed of a whole wire mesh, and is easy to use.

The using method and working method of the present invention are as follows:

When the fence in use, the fence piece units are moved to the designated position, and the connecting hinge 4 is rotated to unfold the fence piece 3 and form a certain included angle. The fence piece unit 1 can stand up naturally without human assistance. A left hinge member 5 of a fence piece unit 1 is connected with a right hinge member 6 of another fence piece unit 1 in pairs correspondingly, then the ground inserting rod 2 is inserted, and the ground inserting rod 2 is inserted vertically into the ground and fixed, and the fence piece units 1 are connected to form a fence for use.

When retracting the fence, the ground inserting rod 2 is pulled out from the left hinge member 5 and the right hinge member 6, and the fence pieces 3 are rotated along the connecting hinge 4 to make them close, and then the fence piece units 1 are moved back to completing the retracting of the fence.

Compared with the prior art, the advantageous effects of the present invention are as following:

the present invention is provided with a fence piece unit 1, which includes at least two fence pieces 3 and a connecting hinge 4, and a fence piece 3 and another fence piece 3 are rotatably connected together through the connecting hinge 4 to form a fence piece unit 1 for use. When the fence in use, the fence piece unit 1 can be directly removed out and connected with other fence piece units 1 in pairs to form a fence; when retracting the fence, after separating the fence piece units 1 from each other, the fence pieces 3 in the fence piece unit 1 are rotated and closed along the connecting hinge 4, and then the fence piece units 1 are transported and stowed. Compared with the prior art, in the present invention two or more fence pieces 3 are combined into one fence piece unit 1 for use, which can be directly moved without moving the fence pieces 3 one by one, and the fence pieces 3 can be rotated and closed along the connecting hinge 4, such that it is more convenient to carry and use, and saves time and manpower, and it only needs to connect the fence piece units 1 to form and retract the fence, and does not need to connect the fence pieces 3 one by one, such that the connection saves time and effort, and it is easy to use;

moreover, in the present invention, a left hinge member 5 is arranged on the leftmost fence piece 3 of the fence piece unit 1, a right hinge member 6 is arranged on the rightmost fence piece 3 of the fence piece unit 1, and the left hinge member 5 of a fence piece unit 1 is connected with the right hinge member 6 of another fence piece unit 1. Thereafter the ground inserting rod 2 passes through the left hinge member 5 and the right hinge member 6 until it is inserted into the ground and fixed. Since the left hinge member 5 and the right hinge member 6 are arranged on the fence piece 3, the fence can be inserted into the ground and fixed, and the adjacent fence piece units 1 can be closely connected with the ground inserting rod 2, and the left hinge member 5 and the right hinge member 6 play the role of supporting and restraining the ground inserting rod 2, so the anti-interference ability of the ground inserting rod 2 is enhanced, and the ground inserting rod 2 is not easy to be blown down by the wind;

furthermore, the fence piece unit 1 includes at least two fence pieces 3, and the fence pieces 3 are rotatably connected together by a connecting hinge 4. The fence pieces 3 can rotate around the connecting hinge 4. When the fence pieces 3 are rotated to make a certain angle between the two fence pieces 3, the fence piece units 1 can temporarily stand on the flat ground without human assistance, i.e. supporting by hand, and the user can connect the adjacent fence piece units 1 alone without the assistance of other people, thereby saving manpower and installing convenient.

Therefore, the present invention provides a hinged quick installation fence, which can be transported, installed and stored more conveniently by combining two or more fence pieces 3 into a fence piece unit 1, thereby saving manpower and time costs.

The above are only the preferred embodiments of the present invention. It should be noted that the above preferred embodiments should not be regarded as limitations of the present invention, and the protection scope of the present invention should be based on the scope defined by the claims. For those skilled in the art, several improvements and modifications can be made without departing from the spirit and scope of the present invention, and these improvements and modifications should also be regarded as the protection scope of the present invention.

What is claimed is:

1. Hinged quick installation fence, comprising at least two fence piece units and a ground inserting rod, each of the said fence piece units including at least two fence pieces and a connecting hinge, the said fence pieces being rotatably connected together by the said connecting hinge, the leftmost fence piece being provided with a left hinge member, the rightmost fence piece being provided with a right hinge member, the adjacent fence piece units being connected in pairs correspondingly through the said left hinge member and the said right hinge member, and the said ground inserting rod being inserted into the said left hinge member and the said right hinge member and fixed, and the said fence piece units forming a fence for use; at least one of the said fence pieces arranges a fence gate; the said fence gate includes a gate frame, a bolt and a lifting connecting shaft, a slot is arranged on the said fence piece, the said fence gate is fixed by inserting the said bolt into the said slot, the said lifting connecting shaft connects the said gate frame and the said fence piece, and the said lifting connecting shaft is provided with a position limiter and an avoidance part, the said position limiter restricts the lifting upward movement of the said gate frame along the said lifting connecting shaft, after the position limiter inserted into the said avoidance part, the said gate frame is lifted up along the lifting connecting shaft to drive the said bolt to unlock from the said slot.

2. The hinged quick installation fence according to claim 1, wherein the said left hinge member and the said right hinge member are provided with hinge holes that penetrate vertically, the said hinge hole on the said left hinge member and the said hinge hole on the said right hinge member are coaxially aligned, and the said ground inserting rod is inserted into the said hinge holes and fixed.

3. He hinged quick installation fence according to claim 1, wherein a ground inserting end of the said ground inserting rod is provided with a shrinking tube tip.

4. He hinged quick installation fence according to claim 1, wherein a hand-held end of the said ground inserting rod is provided with a holding member.

5. He hinged quick installation fence according to claim 1, wherein the said fence piece includes a frame body and a wire mesh, and the said wire mesh is arranged inside the said frame body.

* * * * *